US006710695B1

(12) United States Patent
Pellon et al.

(10) Patent No.: US 6,710,695 B1
(45) Date of Patent: Mar. 23, 2004

(54) AIRCRAFT CIRCUIT BREAKER WITH MANUAL OPENING RESISTANT FEATURE

(75) Inventors: Christian V. Pellon, Norton, MA (US); Karen M. Litwin, Saunderstown, RI (US); Roland G. Morin, Cumberland, RI (US); Peter G. Berg, North Attleboro, MA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/279,638

(22) Filed: Oct. 24, 2002

(51) Int. Cl.[7] ..... H01H 71/58; H01H 9/28

(52) U.S. Cl. ..... 337/66; 337/72; 337/348; 337/358; 200/43.13; 200/43.18; 200/50.09

(58) Field of Search ..... 337/66, 72, 75, 337/333, 334, 348, 358; 200/43.01, 43.04, 43.07, 43.08, 43.11, 43.13, 43.16, 43.18, 43.19, 43.21, 50.01, 50.02, 50.09

(56) References Cited

U.S. PATENT DOCUMENTS 1,117,646 A * 11/1914 Durbin et al. ..... 200/523
1,170,063 A * 2/1916 Heeney ..... 200/532
1,544,467 A * 6/1925 McDonald ..... 200/43.13
2,343,412 A * 3/1944 Immel ..... 200/43.08
3,361,882 A 1/1968 Clarke
3,953,696 A * 4/1976 Reimann et al. ..... 200/522
4,206,328 A * 6/1980 Coyle et al. ..... 200/43.13
4,956,983 A * 9/1990 Okamura et al. ..... 70/241
5,055,643 A * 10/1991 Pardini et al. ..... 200/318.2
5,136,130 A * 8/1992 Daly ..... 200/318.1
5,720,379 A * 2/1998 Schwartz et al. ..... 200/318.1
6,207,915 B1 * 3/2001 Kimura ..... 200/524

* cited by examiner

*Primary Examiner*—Anatoly Votman
(74) *Attorney, Agent, or Firm*—Russell E. Baumann; Frederick J. Telecky Jr.

(57) ABSTRACT

A pushbutton resettable circuit breaker is shown having features to prevent manual opening by simply pulling outwardly on the pushbutton. In one embodiment, the pushbutton (16) is formed with slots (**16*b*) which are configured to provide a reaction surface essentially inaccessible without a special purpose contact opening tool (30). The tool is provided with portions that are insertable into the slots and into engagement with the reaction surfaces for pulling the pushbutton out and manually opening the contacts. In a second embodiment, a small aperture 16*k* is formed through the rating tab and top and wall of the button and in alignment with a movable plunger (28). A special purpose contact opening tool (32, 34**) can be inserted through the aperture to apply a force to the plunger and mechanically trip the circuit breaker.

8 Claims, 6 Drawing Sheets

AIRCRAFT CIRCUIT BREAKER WITH MANUAL OPENING RESISTANT FEATURE

FIELD OF THE INVENTION

This invention relates generally to electrical circuit breakers and more particulary to aircraft circuit breakers having a pushbutton actuator provided with a manual opening resistant feature.

BACKGROUND OF THE INVENTION

Aircraft circuit breakers having a pushbutton actuator for closing a set of electrical contacts in a circuit path are well known. By way of example a circuit breaker of this type is shown and described in coassigned U.S. Pat. No. 3,361,882, the subject matter of which is incorporated herein by this reference. Typically, the pushbutton of such circuit breakers when in the dosed or actuated position can be manually grasped and pulled outwardly to open the contacts and de-actuate the circuit breaker.

Although this feature has served as a convenient mechanism for opening a circuit path, it also provides an easily accessible means for undesirable tampering with the circuit breaker.

SUMMARY OF THE INVENTION

An object of the Invention is the provision of a manually resettable circuit breaker which can be manually moved from the closed circuit position to the open circuit position only with the use of a special purpose tool. Another object is the provision of a tamper resistant circuit breaker to prevent undesirable manual opening of the circuit breaker electrical contacts. Yet another object is the provision of a circuit breaker which overcomes the above-noted limitations of the prior art Briefly, in accordance with the invention, a circuit breaker having a manual reset button is configured so that in the operating, dosed contacts position, there is no exposed surface area for grasping to thereby effectively prevent unauthorized personnel or the like from opening the circuit breaker by pulling out the pushbutton. The circuit breaker is provided with a selected opening to provide access for insertion of a special purpose opening tool to engage a reaction surface and apply a contacts opening force. According to a first embodiment, a pair of diametrically opposed generally L-shaped slots are formed in the pushbutton, the slots having a first portion extending in a direction generally parallel to the longitudinal axis of the pushbutton from the top surface thereof and a second portion extending in a common circumferential direction with the surface of the second portion closest to the top surface of the button forming a reaction surface. A special purpose tool used to mechanically trip the circuit breaker is provided with parallelly extending prongs each having a laterally extending foot extending in opposite directions from one another. The prongs and feet are sized to be receivable in respective first portions of the slots and twistable to insert the feet into the respective second portions of the slots and into alignment with the reaction surface. A force can then be applied to the tool to pull out the pushbutton and manually open the circuit breaker.

The second embodiment is useful with circuit breakers of the type having a plunger capable of motion relative to the pushbutton and attached to the movable contact assembly and which, when the contacts are in the closed position, selected downward movement of the plunger will release the latch maintaining the contacts in the closed position and allow the pushbutton return spring to move the pushbutton upwardly and the contacts opening spring to move the contacts to the open position. In the second embodiment the top face or outer end surface of the pushbutton is provided with a small aperture aligned with a reaction surface on the plunger of the circuit breaker. A special purpose opening tool having an elongated probe portion receivable through the aperture can be used to open the contacts of the circuit breaker by inserting the probe portion through the aperture in the pushbutton end surface and applying sufficient downward force on the plunger.

Other objects, features and advantages of the present invention will appear from the following detailed description of preferred embodiments taken together with the accompanying drawings.

DETAILED DESCRIPTION OF PREFERRED EMBODIMENTS

Figure 1:
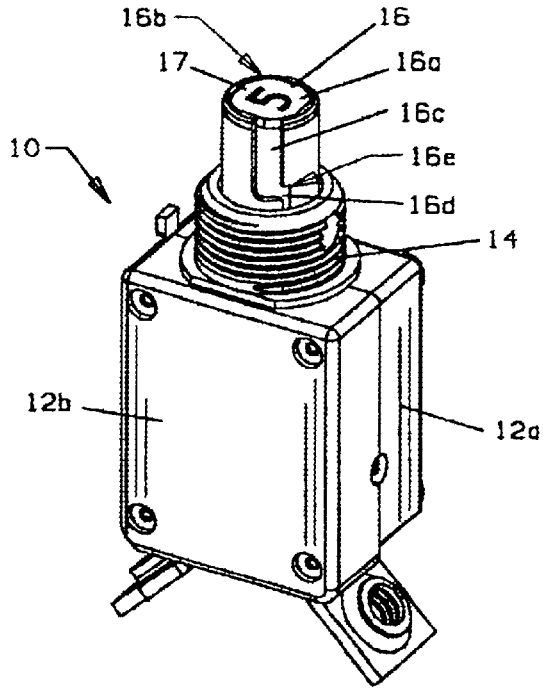
FIG. 1 is a perspective view of an aircraft circuit breaker made in accordance with a first preferred embodiment of the invention in an open contacts condition.
Figure 2:
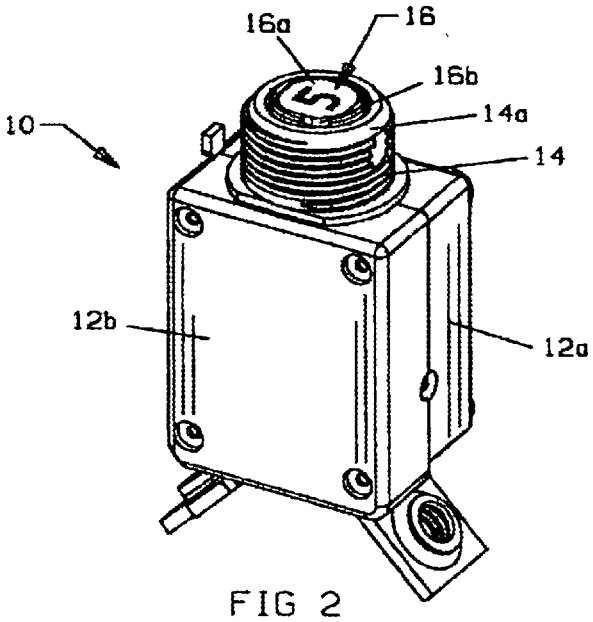
FIG. 2 is similar to FIG. 1 but shows the circuit breaker in the closed contacts condition.
Figure 3:
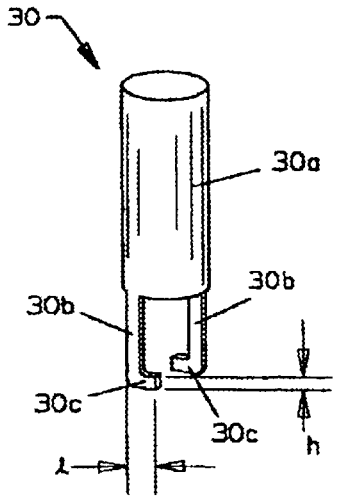
FIG. 3 is a perspective view of a special purpose contact opening tool useful in the FIGS. 1, 2 embodiment.
Figure 4:
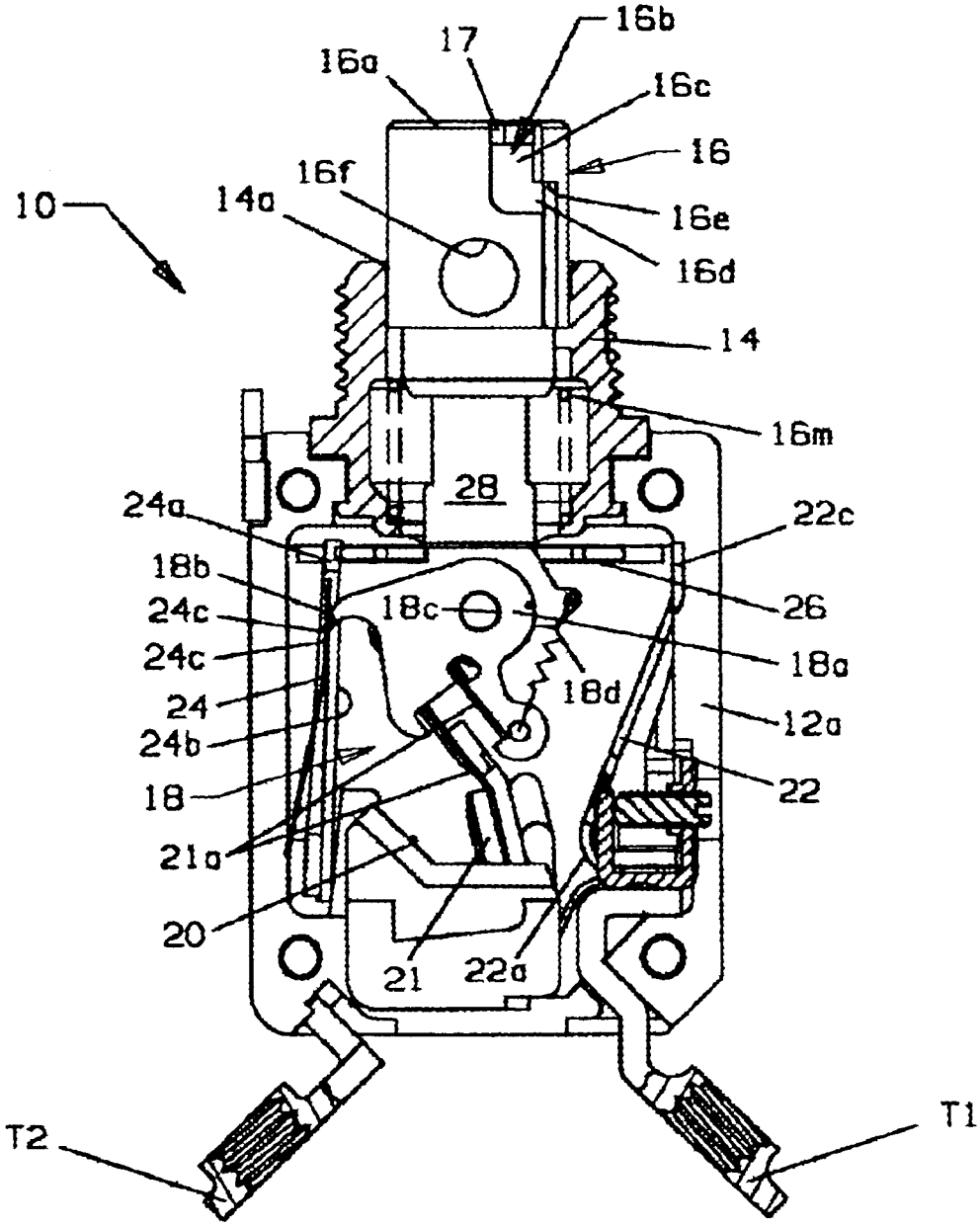
FIGS. 4 and 5 are elevational views of the FIGS. 1, 2 circuit breaker, respectively, with, a case half removed for illustration and with certain parts shown in cross section.

Turning to FIGS. 1–5 of the drawings, circuit breaker 10 made in accordance with a first preferred embodiment comprises a housing 12 having case halves 12*a*, 12*b*, a mounting bushing 14, a pushbutton 16 slidably movable within the bore of bushing 14 between an open contacts position in which the top surface 16*a* of the pushbutton extends outwardly beyond the open end of bushing 14 as shown in FIGS. 1 and 4, and a dosed contacts position in which the top surface 16*a* of the pushbutton is essentially flush with the end surface 14*a* of the open end of bushing 14.

Figure 5:
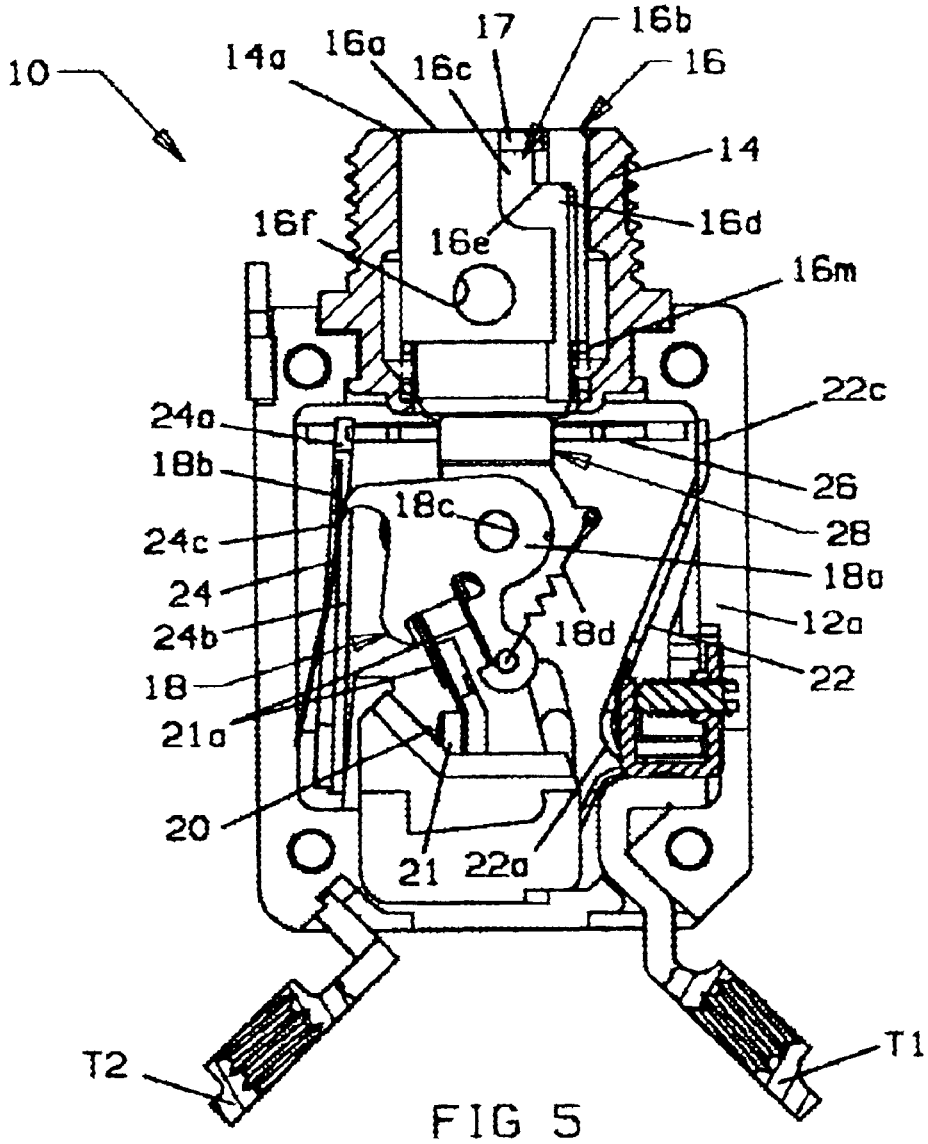
Figure 6:
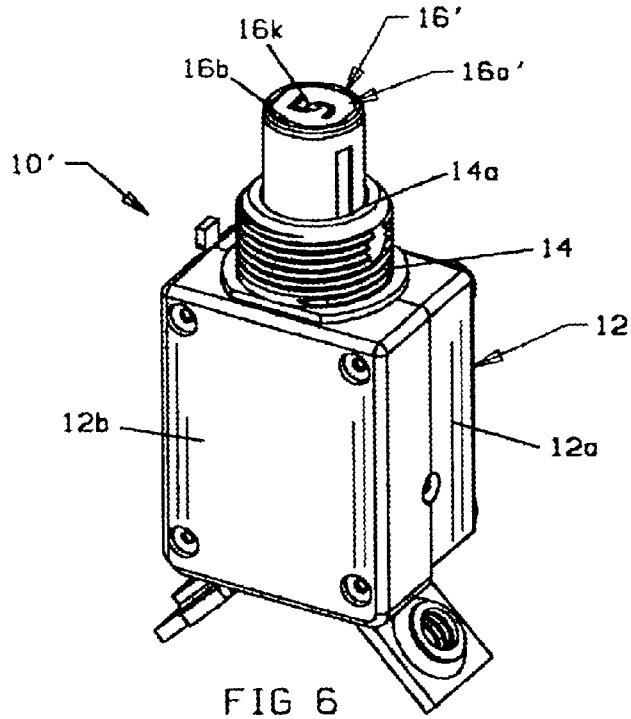
FIGS. 6 and 7 are perspective views, similar to FIGS. 1 and 2, respectively, of a circuit breaker made in accordance with a second preferred embodiment of the invention.
Figure 7:
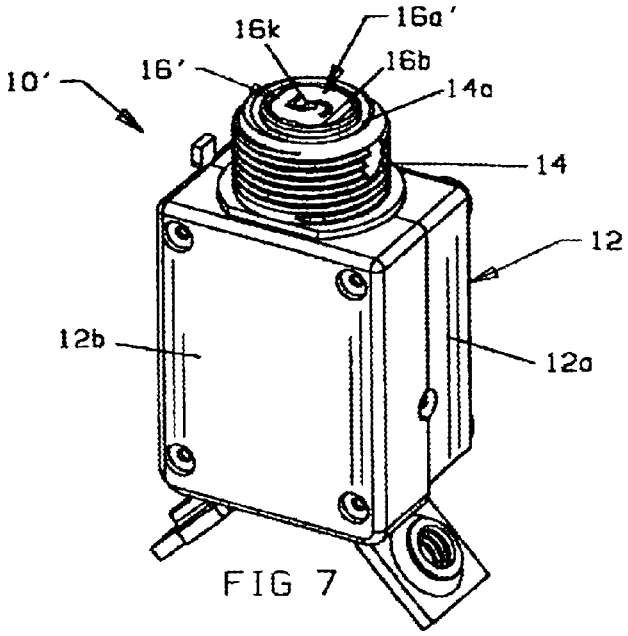

With particular reference to FIG. 4 (showing open contacts) and FIG. 5 (showing closed contacts), circuit breaker 10 has a movable contact assembly 18 which mounts a movable bridging electrical contact 21 for movement between an open contacts position and a closed contacts position with a pair of stationary electrical contacts 20, one of which being indicated in the drawings. The circuit breaker has first and second electrical terminals T1, T2 mounted in and extending out of housing 12. Terminal T2 is electrically connected to a first of the pair of electrical contacts 20 while terminal T1 is connected to a current carrying bimetal element 22 mounted in housing 12 and configured, for example, as a generally U-shaped element.

Figure 9:
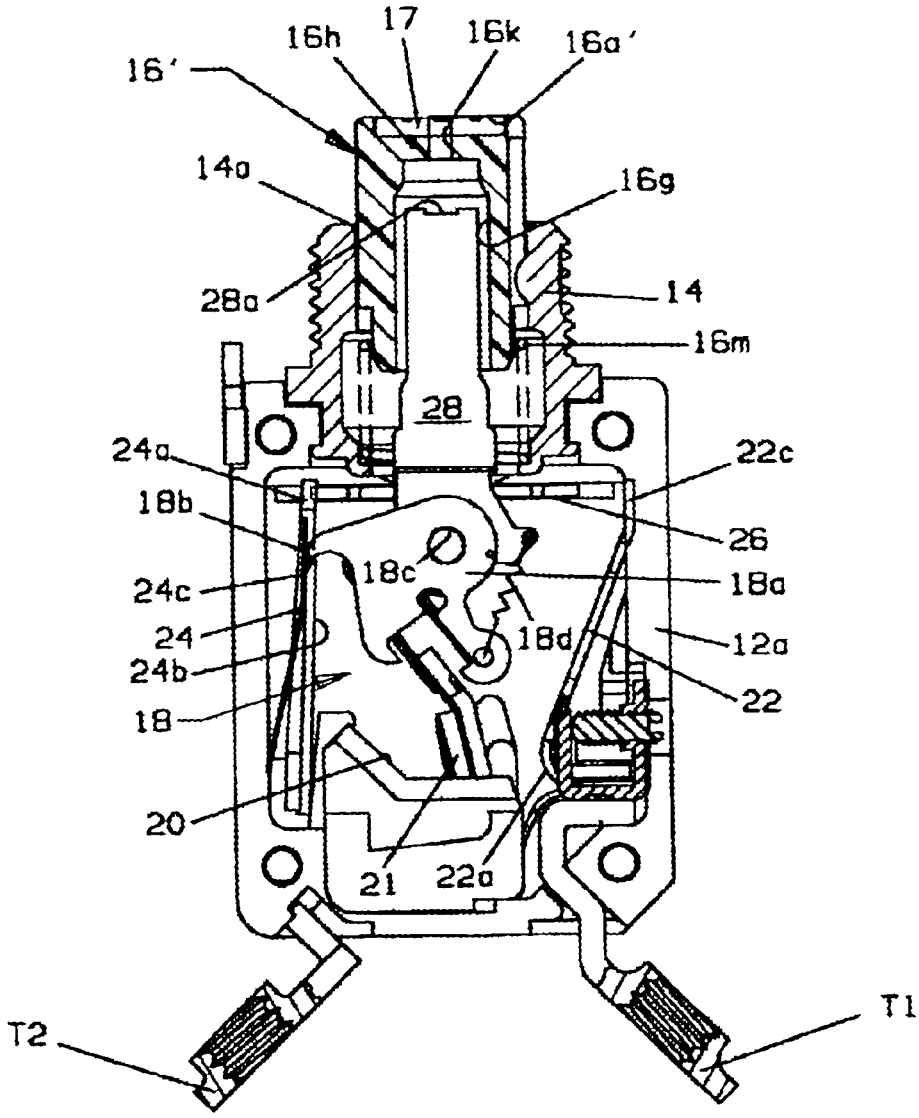
FIGS. 9 and 10 are elevational views, similar to FIGS. 4 and 5, of the FIGS. 6, 7 circuit breakers, respectively, and FIG. 11 a cross sectional elevational view of an alternative special purpose contact opening tool for use with the FIGS. 6, 7 embodiment.
Figure 10:
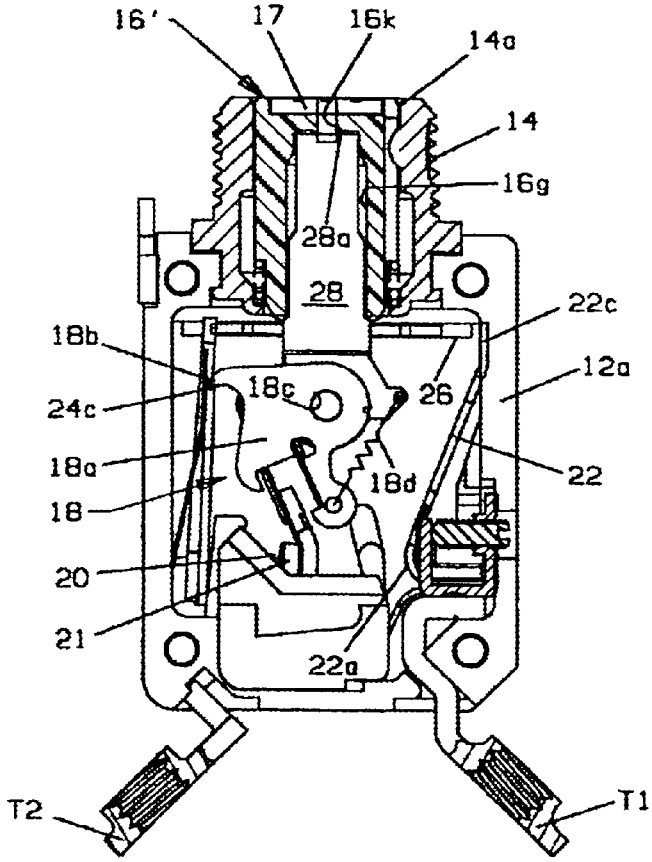

The free end 22*a* of one leg of the U-shaped element is fixedly mounted in the housing and electrically connected to terminal T1 while the other end of the U-shaped element, also fixedly mounted in the housing, is electrically connected to the second of the pair of stationary electrical contacts 20 by means of a strap (not shown) and with the bight portion 22*c* of the U-shaped element arranged to deflect to the left relative to the position shown in FIGS. 4, 5, with an increase in temperature of the element. Movable bridging electrical contact 21 is mounted on contact leaf spring 21*a* which in turn is mounted on bell crank 18*a* pivotably mounted on plunger 28. Plunger 28 is slidingly received in a bore of pushbutton 16 (see bore 16*g* in FIGS. 9 and 10) and operatively connected thereto by a plunger latch, discussed in detail in U.S. Pat. No. 3,361,882 referenced above, but not shown in FIGS. 4 and 5, except for latch ball receiving opening 16*f*.

A non-current carrying ambient compensation bimetal element 24 has one end pivotably mounted in housing 12 and a distal free end 24*a* disposed in selected spaced apart alignment with bight 22*c* of current carrying bimetal 24 with the spacing between free end 24*a* and bight 22*c* remaining constant with changes in ambient temperature. A catch member 24*b* having a ledge 24*c* is attached to the ambient compensating bimetal element only at the base thereof so that the position of ledge 24*c* is unaffected by ambient temperature variations.

When in the contacts closed position with the pushbutton and plunger depressed and latched by the plunger latch, the bell crank latch 18*b* engages ledge 24*c* of catch member 24*b* limiting counterclockwise rotation of bell crank 18*a* about the pivot connection 18*c* with plunger 28. Upon a selected overload in current passing through bimetal element 22, the element will increase in temperature and bight 22*c* will deflect to the left compared to the position shown in FIGS. 4, 5. This motion is transferred to ambient compensation bimetal 24 through a slidably mounted motion transfer plate 26 which also moves catch member 24*b* and ledge 24*c* to the left to trip the circuit breaker by allowing contact opening spring 18*d* to pivot the bell crank 18*a* counterclockwise as seen in the drawings about pivot connection 18*c* on plunger 28 and move the movable contact to the open (FIG. 4) position with plunger 28 moving upwardly along with pushbutton 16 under the influence of pushbutton return spring 16*m* to a position with top surface 16*a* of pushbutton 16 spaced from and above end surface 14*a* of bushing 14. The outer cylindrical surface of pushbutton button 16 can be provided with a selected color contrasting with the surrounding structure, e.g., white, to enhance visibility of a tripped circuit breaker, if desired.

As long as bight 22*c* is in the overload deflected position, the circuit breaker cannot be reset due to the displaced ledge. Upon cooling of the bimetal element 22 and a return of bight 22*c* to the FIG. 4 position pushbutton 16 can be depressed with latch 18*b* engaging ledge 24*c* of catch member 24*b* and permitting closure of the contacts.

Further details of the operation of the circuit breaker can be obtained in U.S. Pat. No. 3,361,882 referenced supra. In that patent, the pushbutton extends above the mounting bushing when the contacts are in the closed position so that the pushbutton can be grasped and pulled in an outward direction allowing the disengagement of the plunger latch which allows the contacts to move to the open contacts position. In accordance with the present invention as described above, the top end surface 16*a* of pushbutton 16, when in the contacts closed position, is essentially flush with the open end surface 14*a* of bushing 14 thereby preventing anyone from grasping the pushbutton In order to pull out the pushbutton and de-actuate the circuit controlled by the circuit breaker.

In accordance with the first preferred embodiment of the invention, pushbutton 16 is formed with a pair of spaced apart diametrically opposed, generally L-shaped slots 16*b*. Each slot comprises a first slot portion 16*c* which extends in a direction generally parallel with the longitudinal axis of pushbutton 16 and having a selected width and a second communicating arcuate slot portion 16*d* extending in a common circumferential direction, i.e., the arcuate slots extend along a line, lying in a plane generally perpendicular to the longitudinal axis. The surface defining the upper extremity of the second slot portion serves as a reaction surface 16*e* for a purpose to be described.

With reference to FIG. 3, a special purpose contact opening tool 30 is shown comprising a body portion 30*a* from which a pair of prongs 30*b* extend in generally parallel directions and being spaced, apart a distance selected to be receivable in slots 16*b*. A foot 30*c* extends laterally from the free distal end of each prong 30*b* in opposite directions from one another. Preferably, the feet are arc shaped so that the feet extend from the prongs in a common circumferential direction relative to an imaginary circle of which the arcs form separate segments thereof. The length l of each arc is selected to be accommodated along with its respective prong in first slot portion 16*c* and the height h of each foot is selected to be accommodated in second slot portion 16*d*.

In order to open the circuit breaker contacts, prongs 30*b* are inserted into respective first slot portions 16*c* and the tool is then twisted so that feet 30*c* enter into respective second slot portions 16*d* and then the tool is pulled outwardly with feet 30*c* placing a force on reaction surface 16*e* to pull out the pushbutton.

It will be appreciated that although a pair of slots is preferred and has been described, it is within the purview of the invention to use a different number of slot and prong combinations, such as three equally spaced slots and prongs for example. Further, although it is preferred to form the feet arcuately, feet extending in a straight line could be used as long as the slot is sufficiently deep to accommodate the feel As shown, slots 16*b* have a further slot extending from the extremity of second slot portion 16*d* opposite to first slot portion 16*b*; however, that is shown for the convenience of forming slot portion 16*d* and does not relate to the opening procedure itself.

A second preferred embodiment is shown in FIGS. 6–10 which comprises the same circuit breaker as in the FIGS. 1–5 embodiment described above with a modified pushbutton 16'. Pushbutton 16' is formed so that top surface 16*a*', as in the first embodiment, is essentially flush with the open end surface 14*a* of mounting bushing 14 when the contacts are in the closed position. Pushbutton 16' is formed with an opening 16*g* open at its inner end for slidable reception of plunger 28 and having an end wall 16*h*. According to the second embodiment, a relatively small aperture 16*k* is formed through the end wall 16*h* and rating tab 17 and aligned with plunger 28.

Figure 8:
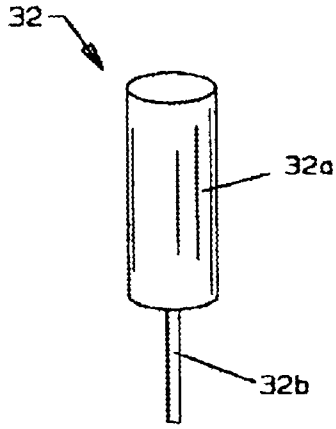
FIG. 8 is a perspective view of a special purpose contact opening tool useful in the FIGS. 6, 7 embodiment.

Special purpose contact opening tool 32, useful with the circuit breaker of the second embodiment, is shown in FIG. 8 and comprises a body portion 32*a* having a single rigid prong 32*b* extending therefrom having a size slightly smaller than aperture 16*k* to allow sliding reception of prong 32*b* through aperture 16*k*. A force applied to reaction surface 28*a* will depress the plunger relative to the pushbutton releasing the plunger and resulting in a mechanical trip of the circuit breaker.

Figure 11:
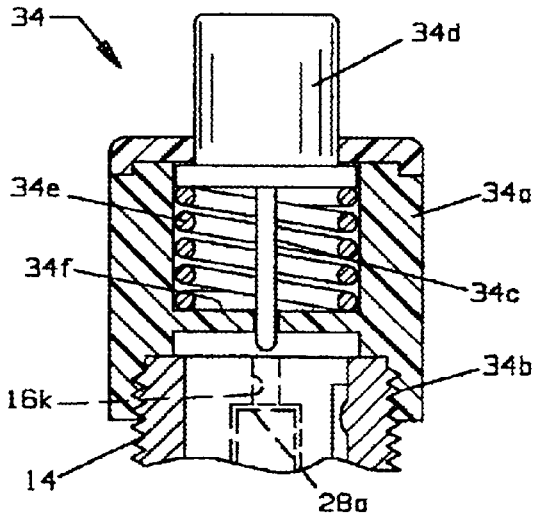

With reference to FIG. 11, an alterative special purpose contact opening tool 34 is shown comprising a body portion 34*a* having a bushing receiving opening 34*b* for reception on an open end of mounting bushing 14 of a circuit breaker 10'. Opening 34*b* may be threaded for threaded engagement with the threads of bushing 14 or not as desired. An elongated, rigid, vertically movable probe 34*c* extends from pushbutton 34*d* which is spring loaded by coil spring 34*e* disposed between the pushbutton bottom surface and a probe alignment shelf 34*f* of body portion 34*f* and shown in the drawing in the normal, at rest recessed condition. Tool 34 can be placed on bushing 14 of a circuit breaker to be manually tripped, as shown, with probe 34*c* automatically aligned with aperture 16*k* so that pushing down on pushbutton 34*d* will cause probe 34*c* to move downwardly into aperture 16*k* striking reaction surface 28*a* to cause a mechanical trip of the circuit breaker.

It should be understood that although particular embodiments of the invention have been described by way of illustrating the invention, other embodiments and variations are possible. It Will be understood that the first embodiment of the invention applies to any manually resettable circuit breaker having a push-pull pushbutton. The second embodiment of the invention applies to any circuit breaker in which downward movement of a movable contact assembly plunger aligned with a pushbutton causes a mechanical trip. It is intended that the invention include all modifications and equivalents of the disclosed embodiments within the scope of the claims.

What is claimed:

1. A circuit breaker having a manual opening resistant feature comprising:

a housing, at least one stationary electrical contact mounted in the housing, a movable contact assembly having at least one movable electrical contact movable between open and dosed contact positions with the at least one stationary electrical contact, a bushing extending from the housing and having an open end, a generally cylindrical pushbutton having a longitudinal axis and having a top surface, the pushbutton slidingly received in the bushing between an outer position with the top surface spaced out of the open end of the bushing and an inner position generally even with, the open end of the bushing, the pushbutton operatively coupled to the movable contact assembly for moving the movable contact into the closed contact position in response to movement of the pushbutton to the inner position and for moving the movable contact into the open contact position in response to movement of the pushbutton to the outer position, a reaction surface formed in the circuit breaker and an opening formed in the pushbutton providing access to the reaction surface whereby a contact opening force can be applied to the reaction surface.

2. A circuit breaker according to claim 1 in which the pushbutton is formed with at least one slot having a first portion extending in a direction generally parallel to the longitudinal axis and a second portion extending laterally from the first portion, the second portion defined, by upper and lower pushbutton surfaces with the upper surface being the reaction surface whereby a tool having a laterally extending foot extending from a distal free end of a probe receivable in the slot can be inserted into the slot with the foot received on the reaction surface.

3. A circuit breaker according to claim 2 in which the at least one slot comprises two slots diametrically opposed to one another.

4. A circuit breaker according to claim 1 in which the pushbutton has an end wall on which the top surface is located and the end wall is formed with a small aperture through the top surface and the end wall and aligned with the reaction surface.

5. A circuit breaker having a manual opening resistant feature comprising:

a housing, at least one stationary electrical contact mounted in the housing, a movable contact assembly having at least one movable electrical contact movable between open and closed contacts positions with the at least one stationary electrical contact, a movable plunger attached to the movable contact assembly, a bushing extending from the housing and having an open end, a generally cylindrical pushbutton having a longitudinal axis and having a top surface slidingly received in the bushing and operatively connected to the plunger, the pushbutton movable between a first depressed position generally even with the open end of the bushing and a second outward position extending out of the open end, and a pair of diametrically opposed generally L-shaped slots formed in the pushbutton, the slots having a selected width, each slot having a first portion extending in a direction generally parallel to the longitudinal axis of the pushbutton from the top surface thereof and a second arc shaped portion extending along a common circumferential direction, both second portions lying in planes generally perpendicular to the longitudinal axis with the upper surface defining the arc shaped portion forming a reaction surface displaced from the first portion of the respective slot.

6. A circuit breaker according to claim 5 further comprising a manual contact opening tool comprising:

a body, a pair of elongated generally parallelly extending prongs extending from the body to a free distal end, and a laterally extending foot extending from the free distal end of each prong and extending from each prong in opposite directions from one another, the feet being receivable in the respective first slot portions and twistable into respective second slot portions.

7. A circuit breaker having a manual opening resistant feature comprising:

a housing, at least one stationary electrical contact mounted in the housing, a movable contact assembly having at least one movable electrical contact movable between open and closed positions with the at least one stationary electrical contact, a movable plunger attached to the movable contact assembly and formed with a reaction surface, selected downward movement of the plunger causing a tripping of the circuit breaker from a closed contacts position to an open contacts position, a bushing extending from the housing and having an open end, a generally cylindrical pushbutton having a longitudinal axis and having an end wall with a top surface slidingly received in the bushing, the pushbutton movable between a first depressed position generally even with the open end of the bushing and a second outward position extending out of the open end, and a relatively small aperture defined in the end wall through the top surface aligned with the reaction surface on the movable plunger.

8. A circuit breaker according to claim 7 further comprising a manual contact opening tool comprising:

a body, and a generally rigid elongated probe extending from the body to a distal free end, the probe having an outer circumference selected to be closely insertable through the aperture in the end wall of the pushbutton and having a length sufficient to engage the reaction surface and transfer sufficient force to trip the circuit breaker.

* * * * *